US005707137A

United States Patent [19]

Hon

[11] Patent Number: 5,707,137

[45] Date of Patent: Jan. 13, 1998

[54] PORTABLE LIGHT WITH A REMOVABLE FLEXIBLE INTERMEDIATE SECTION TO PERMIT DIRECT CONNECTION BETWEEN THE BASE PORTION AND LIGHT PORTION

[75] Inventor: Ellis Hon, Kowloon, Hong Kong

[73] Assignee: GSL Rechargeable Products, Ltd., Kowloon, Hong Kong

[21] Appl. No.: 514,469

[22] Filed: Aug. 11, 1995

Related U.S. Application Data

[63] Continuation-in-part of Ser. No. 37,403, Apr. 11, 1995, Pat. No. Des. 375,811, and Ser. No. 38,454, Apr. 11, 1995.

[51] Int. Cl.[6] ..... F21L 9/00

[52] U.S. Cl. ..... 362/183; 362/197; 362/198; 362/208

[58] Field of Search ..... 362/183, 190, 362/191, 197, 198, 199, 202, 208, 189, 275, 287

[56] References Cited

U.S. PATENT DOCUMENTS

| | | | |
|---|---|---|---|
| 1,232,824 | 7/1917 | Mayhew | 362/202 |
| 2,185,164 | 5/1939 | Weinreb | 362/421 |
| 2,467,954 | 2/1949 | Becker . | |
| 2,648,762 | 8/1953 | Dunkelberger . | |
| 3,111,277 | 11/1963 | Grimsley | 362/197 |
| 3,393,312 | 7/1968 | Dahl | 362/190 |
| 4,305,560 | 12/1981 | Ban | 248/160 |
| 4,495,550 | 1/1985 | Visciano | 362/197 |
| 4,605,993 | 8/1986 | Zelina, Jr. | 362/191 |
| 5,154,483 | 10/1992 | Zeller | 362/198 |
| 5,197,796 | 3/1993 | Moore | 362/202 |
| 5,385,500 | 1/1995 | Schmidt | 362/189 |
| 5,398,176 | 3/1995 | Ahuja | 362/287 |

FOREIGN PATENT DOCUMENTS

| | | | |
|---|---|---|---|
| 814727 | 3/1937 | France | 362/190 |

*Primary Examiner*—Y. Quach
*Attorney, Agent, or Firm*—Longacre & White

[57] ABSTRACT

A portable flashlight in which the illumination section is detachably connected to one end of a flexible arm, and the battery casing are detachably connected to the other end of the flexible arm, whereby the light may be brought in close proximity with objects to be inspected or worked upon but which are located as to require an angled or bent probe. The flexible arm permits the flashlight head to be stably mounted in an infinite number of positions. The intermediate flexible arm may be removed such that the battery casing and the illumination section may be directly connected together to provide a handheld flashlight capable of use in confined areas.

21 Claims, 6 Drawing Sheets

PORTABLE LIGHT WITH A REMOVABLE FLEXIBLE INTERMEDIATE SECTION TO PERMIT DIRECT CONNECTION BETWEEN THE BASE PORTION AND LIGHT PORTION

This is a continuation-in-part of application Ser. No. 29/037,403 now U.S. Pat. No. D375,811; and Ser. No. 29/038,454 filed on Apr. 11, 1995.

BACKGROUND OF THE INVENTION a) Field of the Invention

This invention relates to a portable flashlight and more particularly to a flashlight in which the light bulb and reflector are detachably connected to one end of a flexible arm, and the battery casing are detachably connected to the other end of the flexible arm, whereby the light may be brought in close proximity with objects to be inspected or worked upon but which are located as to require an angled or bent probe. The flexible arm permits the flashlight head to be stably mounted in an infinite number of positions.

b) Description of Related Art

Portable electric flashlights having a flexible intermediate neck to permit manual deformation of the light position are well known.

U.S. Pat. No. 4,495,550 to Visciano teaches a flexible flashlight capable of providing light at virtually any angle even in an environment in which the area to position a flashlight is extremely limited. A bellows is provided at one end of a main body housing batteries, and a lens is provided at the other end of the bellows. The bellows is made of a semi-rigid material so that once its curvature is formed it will remain fixed indefinitely until reformed by the user.

The prior art flexible flashlight arrangements, however, suffer from numerous drawbacks inherent in their design. Most notably, the prior art portable flashlights having a flexible neck are cumbersome and difficult to manipulate in small areas. In addition, the prior art flexible lights are design for limited use based on the predetermined light generating and emitting characteristics.

The need therefore exists for a flashlight possessing the characteristics of both the traditional handheld flashlight, and flashlights having a flexible neck portion. In addition, the need exists for a flexible flashlight having an interchangeable head portion and battery portion to provide a versatile arrangement adaptable to various environments.

SUMMARY OF THE INVENTION

It is the object of the present invention to provide a flashlight possessing the characteristics of both the traditional handheld flashlight, and flashlights having a flexible neck portion. In addition, the present invention provides a flexible flashlight having an interchangeable head portion and battery portion to provide a versatile arrangement adaptable to various environments.

These and other objects of the present invention will be evident from the description provided below and by reference to the following drawings.

DETAILED DESCRIPTION OF THE PREFERRED EMBODIMENTS

Figure 1:
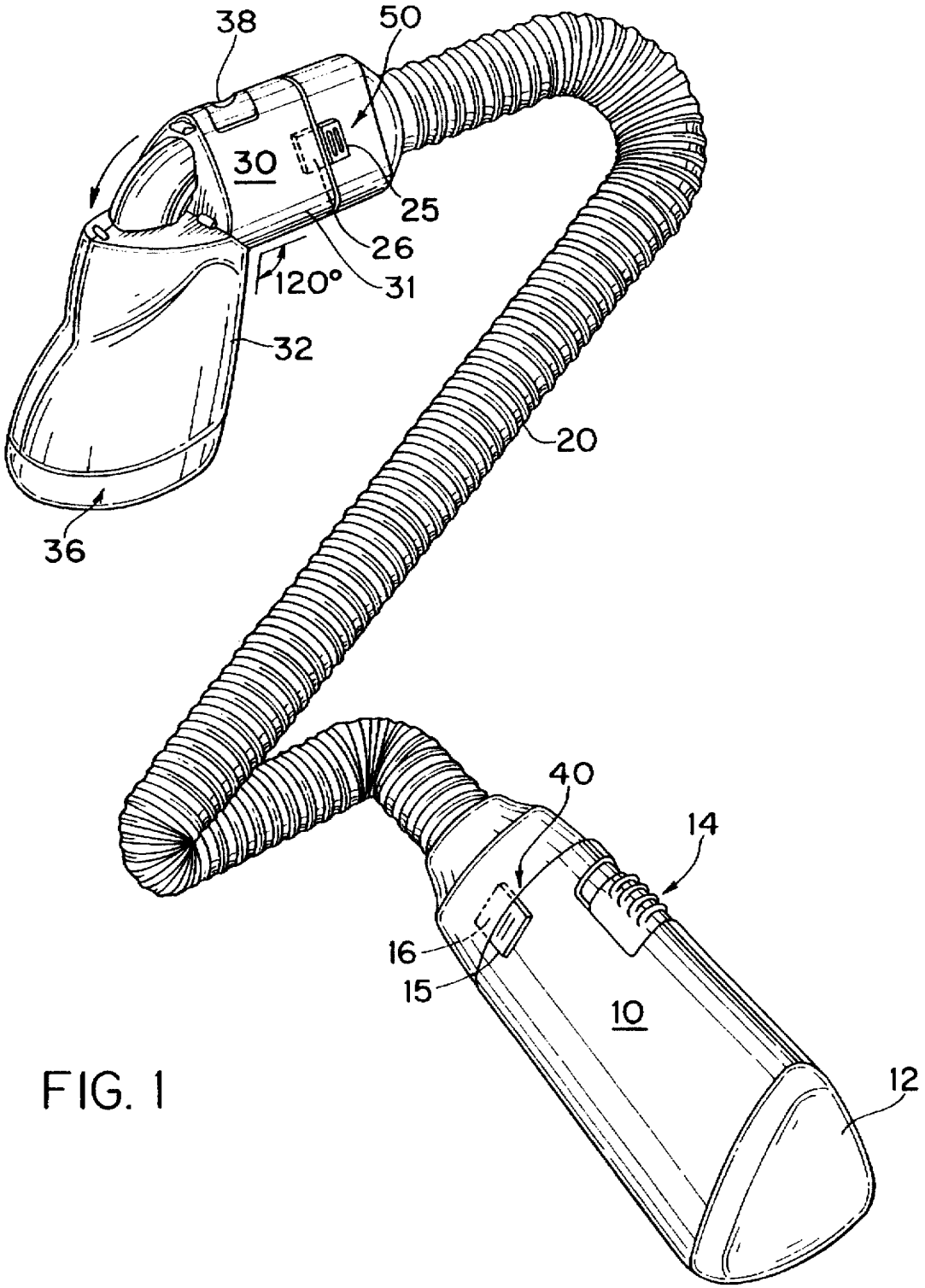
FIG. 1 is a perspective view of the preferred embodiment of the flashlight of the present invention.

With reference to FIG. 1, the flashlight of the present invention comprises a main body portion in the form of handheld member 10, which houses the batteries to provide electrical power for the flashlight in a conventional manner. The handheld member 10 is preferably formed with an ergonomic design suitable for grasping by a user's hand.

Figure 3:
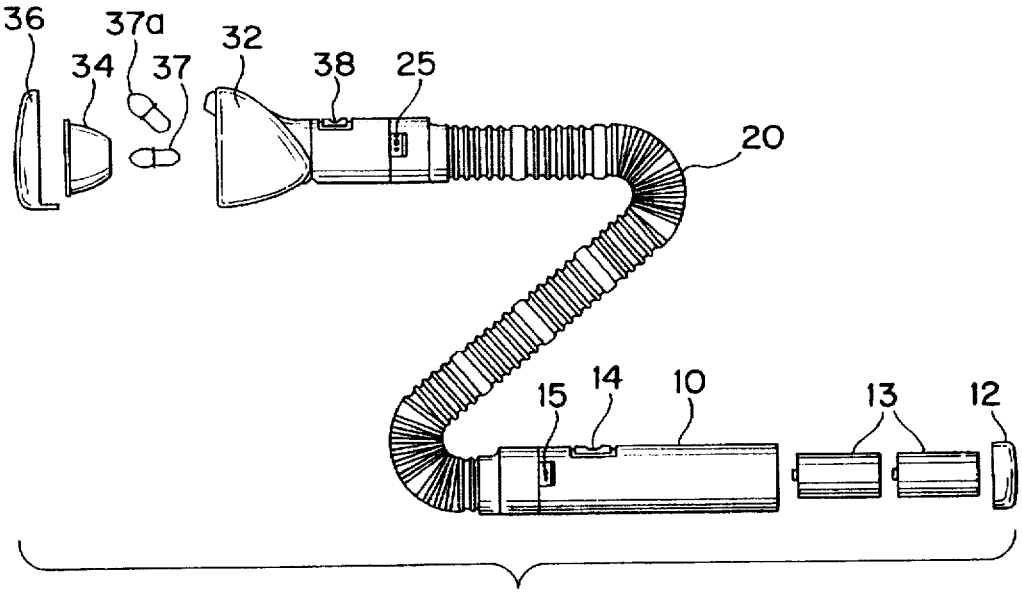
FIG. 3 is an exploded view of the preferred embodiment showing various internal elements of the flashlight.

The main body portion 10 is provided with an access panel 12 for replacing the batteries 13 (see FIG. 3). The access panel may be in the form of a threaded end cap which is screwed to corresponding threads provided on the main body portion 10, or may simply slide-lock onto the main body portion in a conventional manner.

The invention may be turned on and off by sliding switch 14 which completes the circuit between the batteries and a light bulb provided in the light portion in a conventional manner.

A flexible intermediate member 20 is detachably connected to the main body portion 10 by way of a first connector 40. A pair of handle detach buttons 15 are further provided on the main body portion 10 to effect disconnection of the flexible intermediate member 20 from the main body portion 10. The specific design of the first connector 40 will be described in detail below.

Connected to the other end of the flexible intermediate member 20 through a second connector 50 is the light portion 30. In the same manner as provided on the main body portion 10, a pair of handle detach buttons 25 are provided on the flexible intermediate member 20 to effect disconnection of the flexible intermediate portion 20 from the light portion 30.

The light portion 30 primarily comprises a stationary member 31, pivoting lens head 32, a reflector 34, a lens 36 and a light bulb 37 (see FIG. 3). The bulb 37 is suitable received in a socket member (not shown) mounted within the pivoting lens head 32. Release button 38 releases the lens head 32 to enable pivoting movement with respect to the stationary member 31 which is attached to the flexible intermediate portion 20. It is further noted that a replacement bulb **37*a* may be stored in the lens head 32**.

Figure 1A:
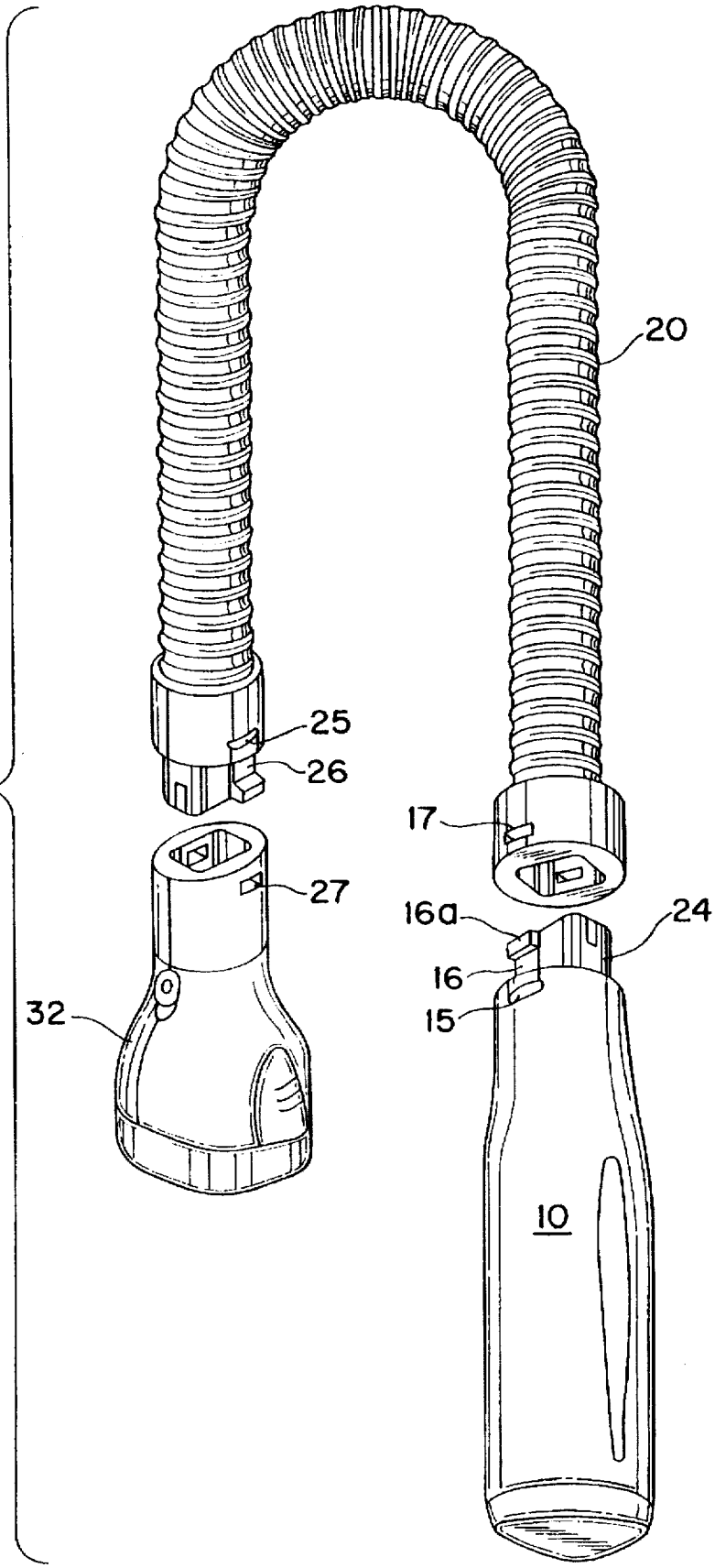
FIG. 1*a* is a perspective view of the preferred embodiment of FIG. 1 with the connector between the intermediate section and each of the main body and light portion shown in a disconnected state.
Figure 2:
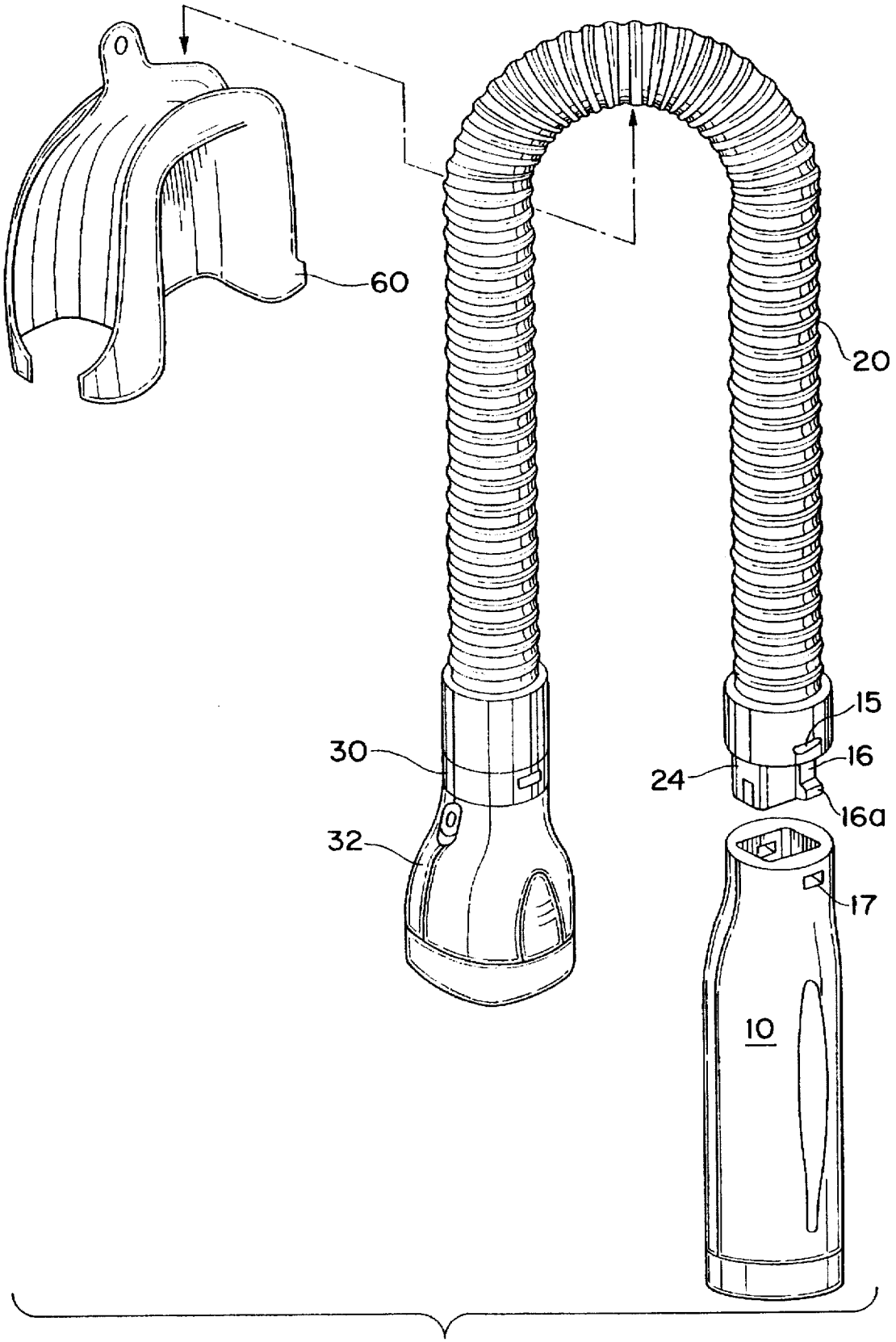
FIG. 2 is a perspective view of an alternate embodiment of the present invention with a connector between the main body and the intermediate section shown in a disconnected state.

Turning now to FIGS. 1*a* and 2, the structure and function of the connectors 40, 50 will now be described. The connectors 40, 50 provide a reliable and inexpensive arrangement for enabling disassembly of the three primary parts: the main body portion 10, the flexible intermediate portion 20, and the flashlight head portion 30. With this arrangement, the main body portion 10 may be connected directly to the light portion 30 to provide a compact flashlight suitable for use in compact areas (see FIGS. 4*a* & 4*b*).

The connector 40 provided at one end of the main body portion 10 consists of a cantilevered tab 16 which extends from a male end 24 of one of the main body portion 10 (FIG. 1) or the intermediate member 20 (FIG. 2). The cantilevered tab 16 comprises a projecting tang 16*a* which is received in an aperture or recess 17 provided on the other of the main body portion 10 (FIG. 2) or the intermediate member 20 (FIG. 1) to enable connection between the intermediate portion 20 and the main body portion 10. A user need only depress the button 15 to release the tab 16 from the recess 17 to thereby separate the intermediate member 20 from the main body portion 10.

A corresponding male/female connection 50 is provided at the other end of the flashlight 1, between the intermediate member 20 and the head portion 30, to enable separation of the members. As shown in FIG. 1, a button 25, which corresponds to button 15, controls the engagement and disengagement of the tab 26 from the head portion 30 to enable disengagement of the head portion 30 from the intermediate member 20.

Figure 4A:
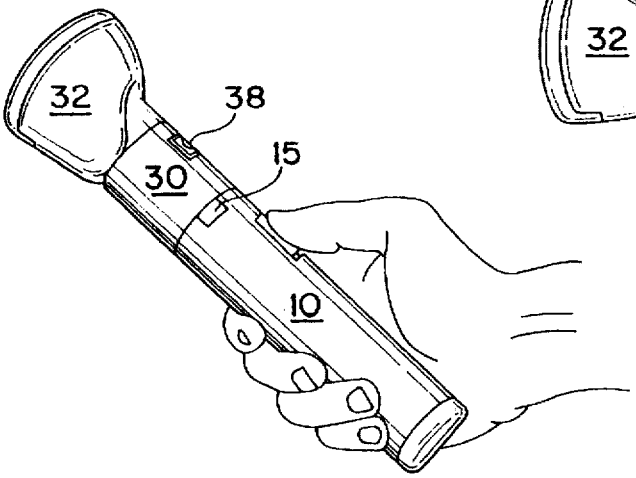
FIG. 4*a* is a perspective view of the preferred embodiment in the form of a handheld flashlight with the intermediate section omitted.
Figure 4B:
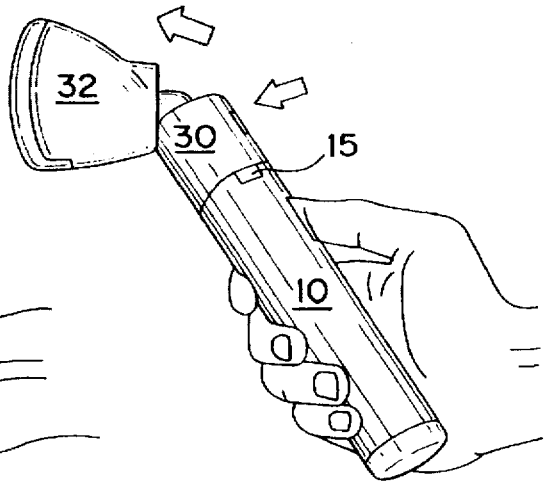
FIG. 4*b* shows the flashlight of FIG. 4*a* with the light head in a pivoted state.

Significant to the present invention is the inclusion of a male connector at one end and a female connector at the opposite end of the intermediate member 20. With this arrangement, upon disengagement of each member 10, 20, and 30, the head portion 30 may be engaged with the main body portion 10 to provide a handheld flashlight; the intermediate member 20 being omitted. The handheld flashlight comprised of the head portion 30 and the main body portion 10 is illustrated in FIGS. 4*a* and 4*b*. The configuration of FIG. 4 is disassembled in the same manner as discussed above whereby the buttons 15, 25 are depressed to dislodge the tabs 16, 26 from a corresponding recess 17, 27. Of course, the invention is not in any way limited to the connectors 40, 50 illustrated in the appended drawings, but may alternately comprise a threaded connection or other suitable arrangement which enables selective connection of the main body portion 10, intermediate member 20, and the lighted head 30.

It will be understood by those of ordinary skill in the art that suitable conductors should be provided at each connector 40, 50 to enable the delivery of electrical power between each of the main body portion 10, intermediate member 20, and the lighted head portion 30.

In addition to the benefits of the novel light assembly discussed above wherein the flexible light arrangement may be disassembled and reconfigured to provide a handheld light as shown in FIGS. 4*a*, 4*b*, the present invention provides numerous additional advantages not present in the prior art. First, more than one intermediate member 20 may be successively linked together to provide a flexible intermediate section whose length may be selected by the user. Moreover, any number of head portions and battery portions may be interchangeably utilized to provide a versatile arrangement adaptable to various environments. For instance, a water-proof head section may be provided for aquatic use, a relatively larger head section may be attached to increase the illumination output, or an emergency light may be attached in emergency situations. Likewise, a rechargeable battery pack or a battery pack having a power cord may be installed for the main body portion.

Figure 5:
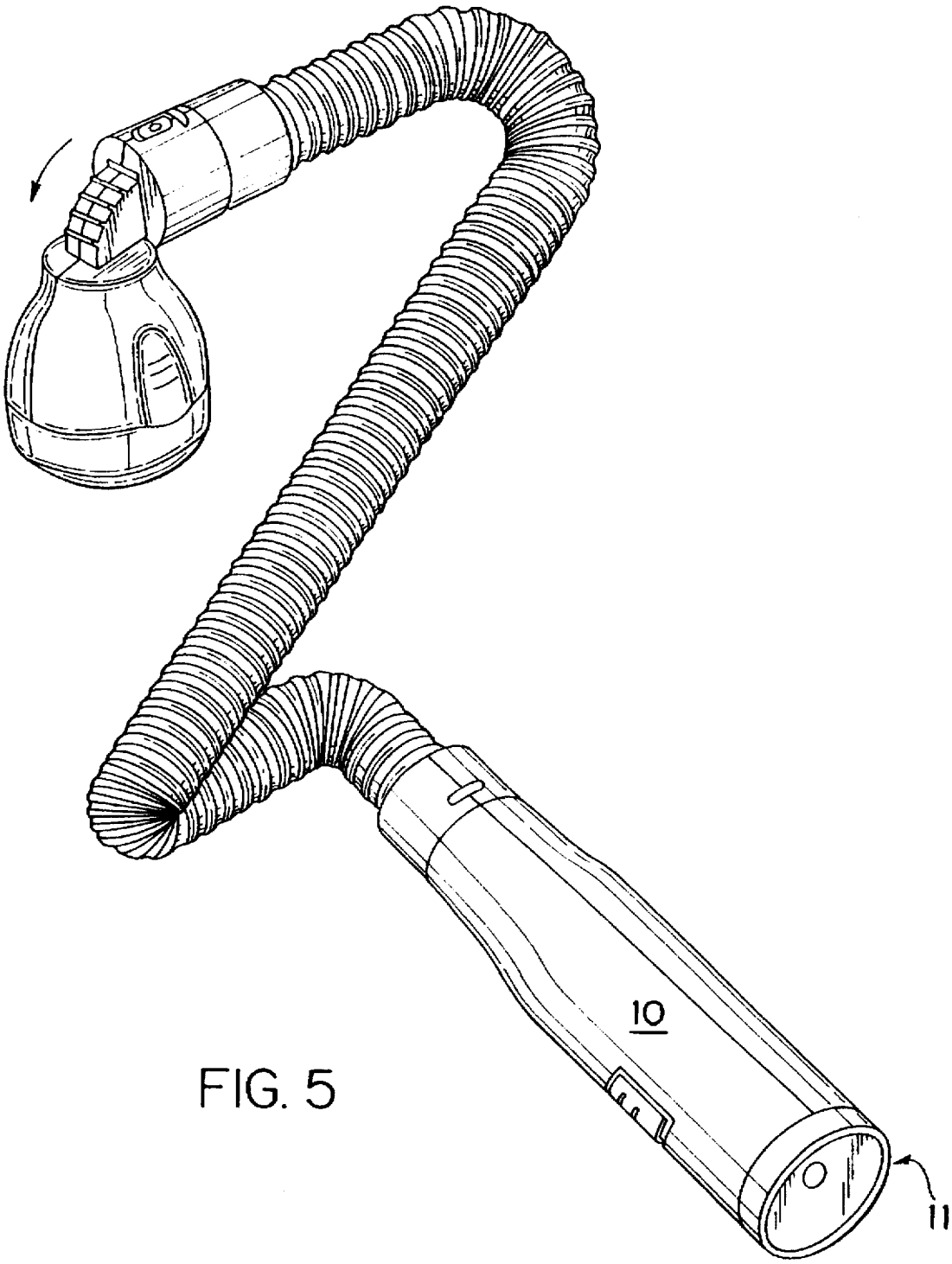
FIG. 5 illustrates an alternate embodiment of the invention whereby a secondary illumination device is provided on the main body portion.

FIG. 5 illustrates an alternate embodiment of the invention wherein the main body portion 10 comprises a battery housing with a secondary lighted end section 11 which is formed at the end of the main body portion 10 at an end opposite the first connector 40.

Figure 6:
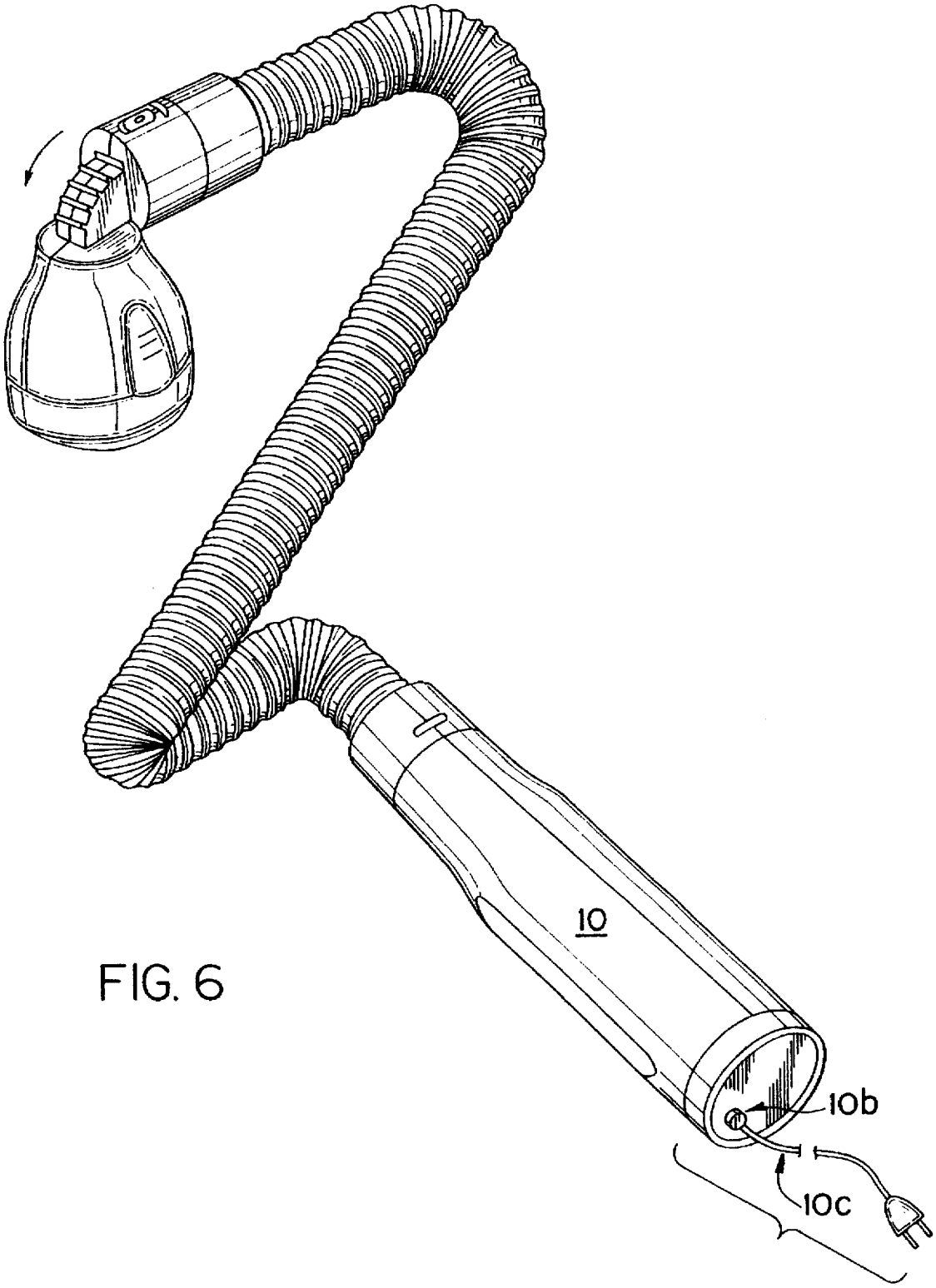
FIG. 6 is a further alternate embodiment of the invention whereby main body portion is provided with an alternate power source and/or forming a rechargeable battery pack.

FIG. 6 illustrates a further alternate embodiment of the invention wherein rechargeable battery pack forms the main body portion 10 and/or a conventional power cord 10*c* is utilized as a means for conveying power for the power source. An adaptor connection 10*b* may be provided for power delivery or recharging. It is noted that such a rechargeable main body portion may be designed for insertion into a recharging pack as is well known in the art of rechargeable products.

As shown in FIG. 2, the present invention is particularly suited for mounting on a wall or the like by way of a wall bracket 60.

While the foregoing invention has been shown and described with reference to a number of preferred embodiments, it will be under by those possessing skill in the art that various changes and modification may be made without departing from the spirit and scope of the invention.

I claim:

1. A flashlight comprising:

a base portion for receiving an electrical current source means for supplying electrical current;

a light portion having an illumination means for generating illuminating light;

connector means for detachably connecting said base portion to said light portion; and a flexible intermediate member removably interposed between said base portion and said light portion, said connector means detachably connecting said base portion and said light portion to said intermediate member, wherein said connector means directly connects said base portion and said light portion upon removal of said intermediate member.

2. The flashlight according to claim 1, wherein said light portion comprises a pivoting lens portion pivotally attached to a main body of said light portion.

3. The flashlight according to claim 1, wherein said intermediate member comprises a first male connector at a first end and a first female receptacle at an opposite end thereof.

4. The flashlight according to claim 3, wherein said first male connector is received by a second female receptacle provided on said light portion and said first female receptacle receives a second male connector provided on said base portion.

5. The flashlight according to claim 1, wherein said base portion comprises a rechargeable electrical power source.

6. The flashlight according to claim 1, wherein said base portion comprises an outlet means for connecting said base portion to an external power source.

7. An illumination device comprising:

a base portion having an electrical current source means for storing and supplying an electrical current;

a light portion having an illumination means for generating illuminating light;

a flexible intermediate member removably interposed between said base portion and said light portion, whereby a relative positioning of said base portion with respect to said light portion is selectively varied by bending said intermediate member; and connector means for detachably connecting said base portion and said light portion to said intermediate member, wherein said connector means directly connects said base portion and said light portion together upon removal of said intermediate member.

8. The flashlight according to claim 7, wherein said electrical current is delivered from said electrical current source means to said illumination means.

9. The flashlight according to claim 7, wherein said light portion comprises a pivoting lens portion pivotally attached to a main body of said light portion.

10. The flashlight according to claim 7, wherein said connector means comprises at least one male connector and at least one female receptacle, said female receptacle configured to matingly receive said male connector to provide a selectively disengageable connection therebetween.

11. The flashlight according to claim 10, wherein said intermediate member comprises a first male connector and a first female receptacle.

12. The flashlight according to claim 11, wherein said light portion comprises said female receptacle of said connector means.

13. The flashlight according to claim 12, wherein said base portion comprises said male connector of said connector means configured to be connected to one said first female receptacle and said female receptacle of said connector means.

14. The flashlight according to claim 11, wherein said light portion comprises said male connector of said connector means.

15. The flashlight according to claim 14, wherein said base portion comprises said female receptacle configured to receive one of said first male connector and said male connector of said connector means.

16. The flashlight according to claim 10, wherein said male connector comprises a cantilevered tang configured for resilient displacement to enable disconnection of said male connector from said female receptacle.

17. The flashlight according to claim 16, wherein said female receptacle comprises an aperture receiving said cantilevered tang.

18. The flashlight according to claim 7, wherein said intermediate member comprises a male connector at one end and a female receptacle at an opposite end, said female receptacle being configured to matingly receive said male connector to provide a selectively disengageable connection therebetween.

19. The flashlight according to claim 7, wherein said connector means comprises a threaded connector.

20. The flashlight according to claim 7, wherein said base portion comprises a rechargeable electrical power source.

21. The flashlight according to claim 7, wherein said base portion comprises an outlet means for connecting said base portion to an external power source.

* * * * *